US010974091B1

(12) United States Patent
Hensler

(10) Patent No.: US 10,974,091 B1
(45) Date of Patent: Apr. 13, 2021

(54) WEIGHT RACK ADJUSTMENT MECHANISM

(71) Applicant: David Hensler, Cedar City, UT (US)

(72) Inventor: David Hensler, Cedar City, UT (US)

( * ) Notice: Subject to any disclaimer, the term of this patent is extended or adjusted under 35 U.S.C. 154(b) by 0 days.

(21) Appl. No.: 16/277,237

(22) Filed: Feb. 15, 2019

(51) Int. Cl.
*A63B 21/062* (2006.01)
*A63B 21/078* (2006.01)

(52) U.S. Cl.
CPC ..... *A63B 21/062* (2013.01); *A63B 21/078* (2013.01)

(58) Field of Classification Search
CPC ..... A63B 21/062; A63B 21/06; A63B 21/068; A63B 21/0728; A63B 21/078; A63B 21/16; A63B 21/00047; A63B 21/0724; A63B 21/0616; A63B 21/08; A63B 21/055; A63B 21/0552; A63B 21/4035; A63B 2244/09; A63B 17/00; A63B 2023/0411; A63B 2225/093; A63B 23/035; A63B 23/03508; A63B 23/03541; A63B 23/03558; A63B 23/04
USPC ..... 482/104, 94
See application file for complete search history.

(56) References Cited

U.S. PATENT DOCUMENTS 4,615,524 A 10/1986 Sutherland
5,954,619 A * 9/1999 Petrone ..... A63B 71/0036 482/104
7,070,547 B1 * 7/2006 Pater ..... A63B 21/078 482/104
9,216,314 B2 * 12/2015 Chen ..... A63B 21/0783
10,058,728 B2 * 8/2018 Kelly ..... A63B 21/16
2007/0129225 A1 * 6/2007 Hammer ..... A63B 21/0552 482/129
2012/0329621 A1 * 12/2012 Lorentz, II ..... A63B 22/0007 482/139
2014/0128229 A1 * 5/2014 York ..... A63B 21/078 482/104
2014/0200117 A1 * 7/2014 Grider ..... A63B 17/04 482/104
2016/0045777 A1 * 2/2016 Haggard ..... A63B 21/0783 482/104
2017/0246490 A1 * 8/2017 Hopperstad ..... A63B 17/04
2019/0247701 A1 * 8/2019 Sergakis ..... A63B 71/0036
2020/0078633 A1 * 3/2020 Chou ..... A63B 21/00069

OTHER PUBLICATIONS

Photograph of lifting hook Author: Unknown Link: https://forum.bodybuilding.com/showthread.php?t=169426333&page=1.
Photograph of lifting hook Author: Unknown Link: https://forum.bodybuilding.com/showthread.php?t=139994253&page=2.

* cited by examiner

*Primary Examiner* — Gary D Urbiel Goldner
*Assistant Examiner* — Thao N Do
(74) *Attorney, Agent, or Firm* — Jones Waldo Holbrook & McDonough, PC; Brent T. Winder

(57) ABSTRACT

A mechanism for adjusting a distance between a first weight rack upright and a second weight rack upright. The mechanism includes bases that conform to a front face of the weight rack uprights. Horizontal pieces are coupled at a first end to the bases and are oriented at a first angle relative to the front face of the weight rack uprights. Bar hooks are coupled to a second end of the horizontal pieces. The bar hooks are oriented at a second angle relative to the horizontal pieces such that the bar hooks are substantially oriented in the first direction. The horizontal pieces are supported by one or more support pieces.

9 Claims, 8 Drawing Sheets

WEIGHT RACK ADJUSTMENT MECHANISM

BACKGROUND

In lifting, and more particularly power lifting, a rack is an essential piece of equipment. An illustrative example of a power lifting rack is depicted in FIG. 11. The power rack 10 includes four vertical uprights 12, 14, 16, 18. Uprights 12, 14, 16, 18 include a series of openings 24 that are designed to receive posts 26 or bar catches allowing for adjustability in height. Spotter bars 30 can also be placed in the openings as a safety measure should the user drop the barbell or need to set it down for other reasons.

The rear horizontal frame elements 20 are usually rigidly connected such as by welding between the upper and lower ends of first and second rear uprights 16 and 18, respectively. Similarly, pairs of side frame elements 22 are usually rigidly connected between the upper and lower ends of first front upright 12 and first rear upright 16, and between the upper and lower ends of second front upright 14 and second rear upright 18. While the dimensions of a power rack 11 are variable, the corner posts or uprights should be both sturdy and spaced apart a sufficient distance so that such support frame apparatus is stable and strong enough to be used as a support for a barbell loaded with several hundred pounds of weights without tipping or collapsing.

Because of their sturdiness requirements, power racks cannot generally be built to allow for adjustment in width. This is problematic because lifters come in a variety of widths. Thus, in a standard power rack, the uprights may be too close together for a lifter to find the desired grip location on the barbell. Similarly, in some circumstances, the rack uprights are too far apart—again preventing the user from finding the desired gripping position. Lifter size aside, there are also situations where a lifter—even if the rack uprights are an otherwise adequate fit—will want to either bring his/her hands in for a closer gripping position or place them farther apart.

Prior art mechanisms to address these issues are generally expensive, cumbersome and prone to breakage and failure. Additional limitations with prior art mechanisms is that they are unable to bear sufficient weight due to a lack of support. Moreover, known mechanisms create a greater risk to lifters' safety. In particular, while they may offset the width of the rack, prior art adjustment mechanisms create a shorter distance between the hook and the upright. This proximity to the upright increases the likelihood that a lifter's hand(s) will collide with the upright causing a dangerous loss of control. Lifters who utilize a wide grip are generally larger as a whole and require more safety measures for all body parts.

Additionally, prior adjustment mechanisms do not allow for much variety in terms of their length or angular orientation. In particular, prior art adjustment mechanisms utilize a layered plate configuration to reduce the width of the rack. This configuration only allows such mechanisms to come substantially straight out from the uprights. Insufficient support in prior art mechanisms also limits their length such that they are not able to accommodate a wide range of lifter grip position preferences.

There is therefore a need for a power rack adjustment system with sufficient support for high load bearing capacity that allows for a variety of lifter sizes and widths and that also accommodates more lifter preferences on gripping position. There is also a need for such an adjustment mechanism that can be universally applied to a variety of power racks regardless of their size, style or brand.

All of the foregoing issues as well as others are addressed by the present invention as described in its various embodiments.

SUMMARY

The invention in its various embodiments includes a mechanism for adjusting a distance between a first weight rack upright and a second weight rack upright. The first weight rack upright includes a front face that is oriented in a first direction and the second weight rack upright includes a second front face that is also substantially oriented in the first direction. The mechanism includes a base that conforms to the front face of the first weight rack upright. A horizontal piece is coupled at a first end to the base and is oriented at a first angle relative to the front face of the first weight rack upright. A bar hook is coupled to a second end of the horizontal piece. The bar hook is oriented at a second angle relative to the horizontal piece such that the bar hook is substantially oriented in the first direction. In one embodiment, the first angle is approximately 45 degrees. In one embodiment, the second angle is approximately 45 degrees. However, the first and second angles could be anywhere less than 90 degrees and greater than zero degrees for inwardly extending adjustment mechanisms. For outwardly extending adjustment mechanisms, the first and second angles in such embodiments could be anywhere less than 180 degrees and greater than 90 degrees. In one embodiment, the first angle is approximately 135 degrees. In one embodiment, the second angle is approximately 135 degrees.

The horizontal piece is supported by one or more support pieces. In some embodiments, the support piece is a gusset plate, which can be positioned beneath the horizontal piece or above the horizontal piece.

The mechanism can include a corner support at the base. The base can also include one or more detachable base connector rods and one or more backside posts.

The adjustment mechanism for a second weight rack upright similarly includes a base that conforms to the front face of the second weight rack upright. This adjustment mechanism likewise includes a horizontal piece coupled at a first end to the base. The horizontal piece is again supported by one or more support pieces. The horizontal piece is oriented at a third angle relative to the front face of the second weight rack upright. A bar hook is coupled to a second end of the horizontal piece and is oriented at a fourth angle relative to the second horizontal piece such that the second bar hook is substantially oriented in the first direction. Again, the third and fourth angles can be anywhere less than 90 degrees and greater than zero degrees on inwardly directed embodiments and anywhere less than 180 degrees and greater than 90 degrees on outwardly directed embodiments.

DESCRIPTION OF ILLUSTRATED EMBODIMENTS

Figure 1:
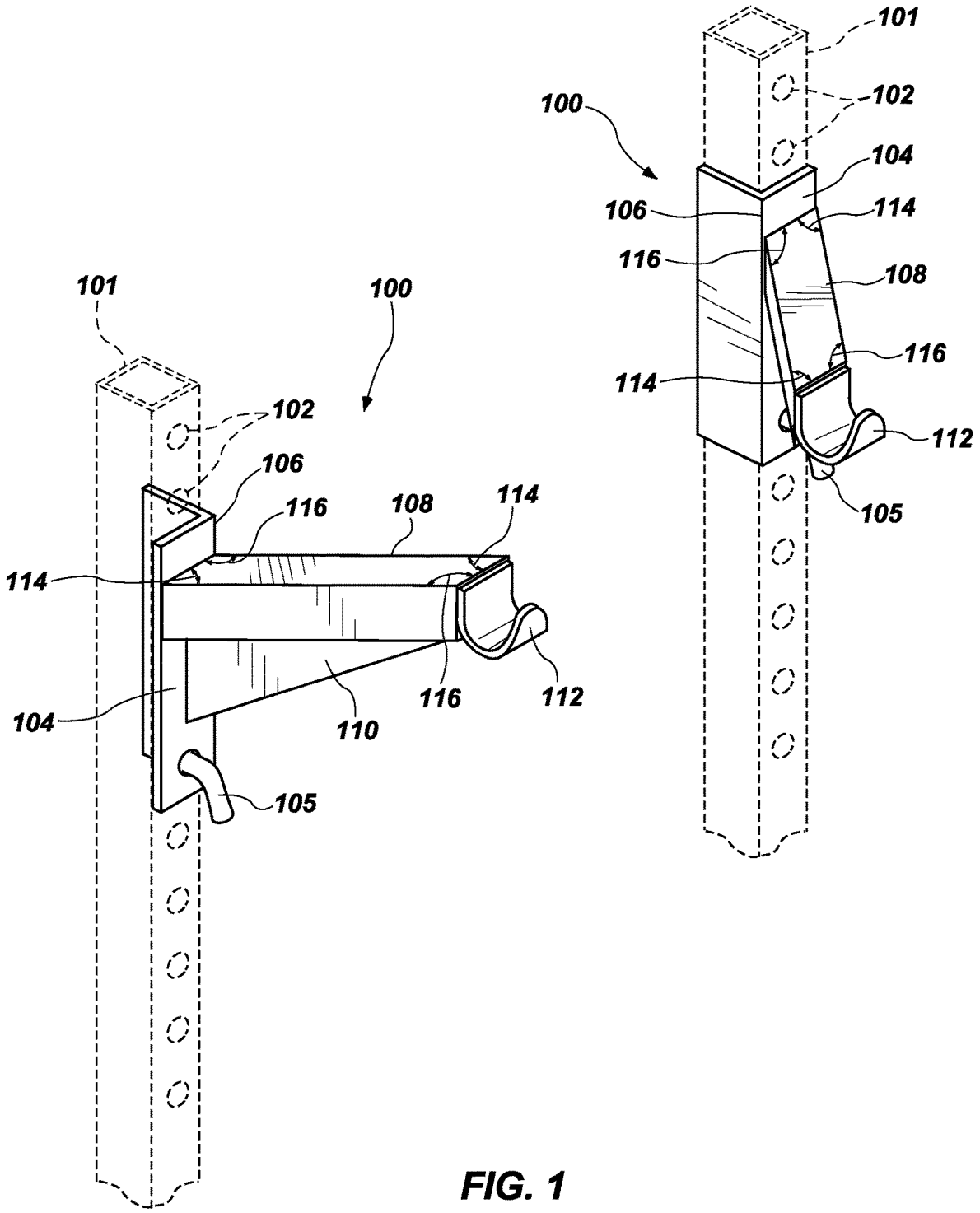
FIG. 1 is a front perspective view of a weight rack adjustment mechanism according to one embodiment of the present invention.

Referring to FIGS. 1 through 5, a weight rack adjustment mechanism 100 is shown according to one embodiment of the present invention. The adjustment mechanism 100 includes a base 104 to which is connected a substantially horizontal piece 108. The term horizontal or substantially horizontal is intended to include pieces that may have a slightly upward or downward angular orientation relative to the surface on which the rack sits. In other words, the horizontal piece 108 need not be exactly horizontal to accomplish its intended purpose and embodiments with some variation in that regard are considered to be within the scope of the appended claims.

Horizontal piece 108 has a bar hook 112 on its end and is supported by support piece 110. In the illustrated embodiment, support piece 110 is a triangular gusset plate affixed to the base 104 and along the underside of horizontal piece 108. However, in other embodiments, the gusset plate could be substantially square or rectangular or numerous other suitable polygonal shapes. The support piece 110 could connect to the base 104 and horizontal piece 108 at a single or multiple points. The support piece 110 could also be one or more rods or beams affixed to both the base 104 and the underside of the horizontal piece 108. The support piece 110 could also be of varying lengths and could attach at various points along both the base 104 and the underside of the horizontal piece 108. In some embodiments, multiple support pieces 110 could be utilized. In other embodiments, the one or more support pieces 110 can support from the top of the horizontal piece 108 rather than the bottom. In yet other embodiments, support pieces 110 can be utilized on both the top and bottom of the horizontal piece 108. In yet other embodiments, one or more support pieces 110 could affix to the sides of horizontal piece 108. For example, one support piece 110 could connect along one side of the horizontal piece 108 and another support piece 110 could connect along the opposite side of the horizontal piece 108 with both support pieces connecting to the base 104 underneath or, in some embodiments, above the horizontal piece 108. Each of these configurations could be used alone or in combination. However, a bottom support piece 110 is particularly useful in maximizing load-bearing capacity of the mechanism 100. A bottom support piece 110 can allow for an adjustment mechanism 100 capable of holding upwards of 1500 pounds of weight.

Base 104 in the illustrated embodiment includes a corner support 106 that substantially conforms with the rack upright 101. Corner support 106 provides additional lateral stability and increases the load-bearing capacity of the weight rack adjustment mechanism 100. It is noted that the term "corner" is not intended to limit the shape of the corner support 106 to any particular angular configuration. For example, in some embodiments, the weight rack adjustment mechanism 100 is conformed to fit with a rounded rack upright 101. In such a case, the corner support 106 could wrap around the upright 101 sufficiently to provide the desired multidirectional support.

Base 104 and corner support 106 can be of varying lengths and widths. For example, in some instances, a longer base 104 may be desirable—i.e. a base 104 that interfaces for a larger lengthwise area with the upright 101. In some instances, a shorter base 104 will suffice. In some instances, a wider base 104 may be wanted—i.e. a base 104 that interfaces with a larger widthwise area of the upright. In some instances, a narrower base 104 will suffice. Similar variation is also possible with the corner support 106.

It is noted that bar hook 112 is depicted as a general hooking mechanism capable of receiving a barbell. However, bar hook 112 as well as bar hook 216, 312 in FIGS. 6-10 could be any number of hooking configurations as are known in the art. "Hook" as used herein is also not intended to be limited to a rounded or substantially rounded shape but could also include numerous other barbell supporting configurations as would be apparent to one skilled in the art including, but not limited to angular barbell receptacles. Bar hook 112, 216, 312 could also include known accessories and features such as bearings used in lifting competitions.

As depicted in FIGS. 1-5, rack 101 typically includes several holes or slots as seen at 102 that accommodate bar catches and allow the height where the bar is rested to be adjusted. Base 104 can include a backside post 107 (FIGS. 2 and 3) that corresponds to the holes 102. A second connector such as rod 105 also serves to secure the base 104 to the rack upright 101. Numerous other configurations of base connection mechanisms are considered within the scope of the present invention. For example, base 104 can include multiple posts 107. In certain embodiments, multiple rods 105 could be utilized. Some embodiments include both features; some include only one. Other known methods for securing bar catches or similarly functioning posts to the rack upright 101 could also be utilized in connection with securing the base 104 to the rack upright 101.

Figure 4:
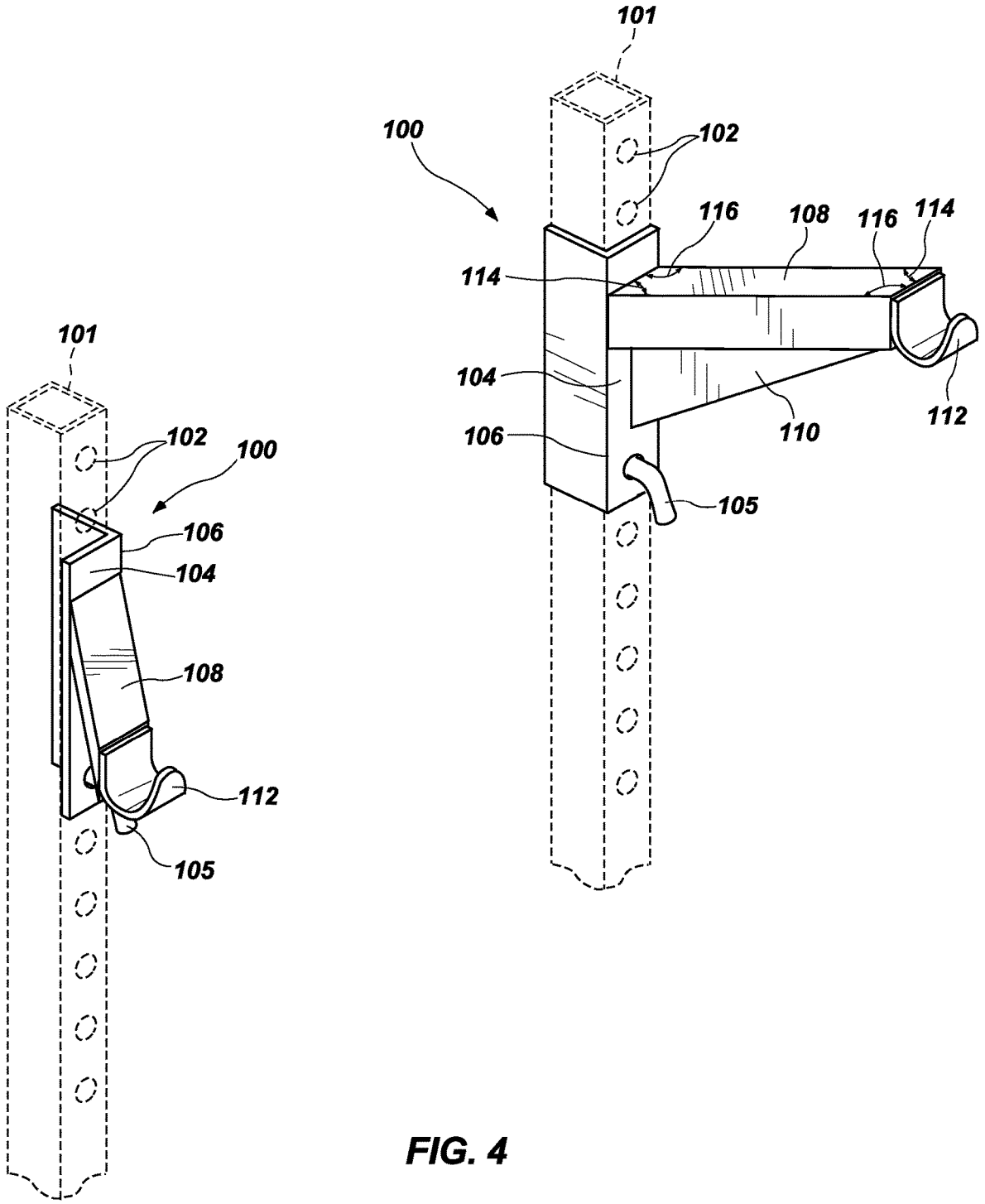
FIG. 4 is a front perspective view of a weight rack adjustment mechanism according to one embodiment of the present invention.

In FIGS. 1 and 4, angles are represented at 114 and 116. In one embodiment, angle 114 is approximately 45 degrees and angle 116 is approximately 135 degrees. However, in certain embodiments, it may be desirable to adjust the angles 114, 116 to allow for a narrower or wider adjustment mechanism 100. For example, referring to FIG. 1, where the rack adjustment mechanism 100 serves to narrow the width of the rack uprights 101, angle 114 could be any angle lower than 90 degrees and greater than zero degrees. Correspondingly, angle 116 could be any angle lower than 180 degrees and greater than 90 degrees.

Referring to FIG. 4, which illustrates an embodiment that increases the width of the rack uprights 101, again angle 114 could be any angle lower than 90 degrees and greater than zero degrees. Correspondingly, angle 116 could be any angle lower than 180 degrees and greater than 90 degrees.

Figure 2:
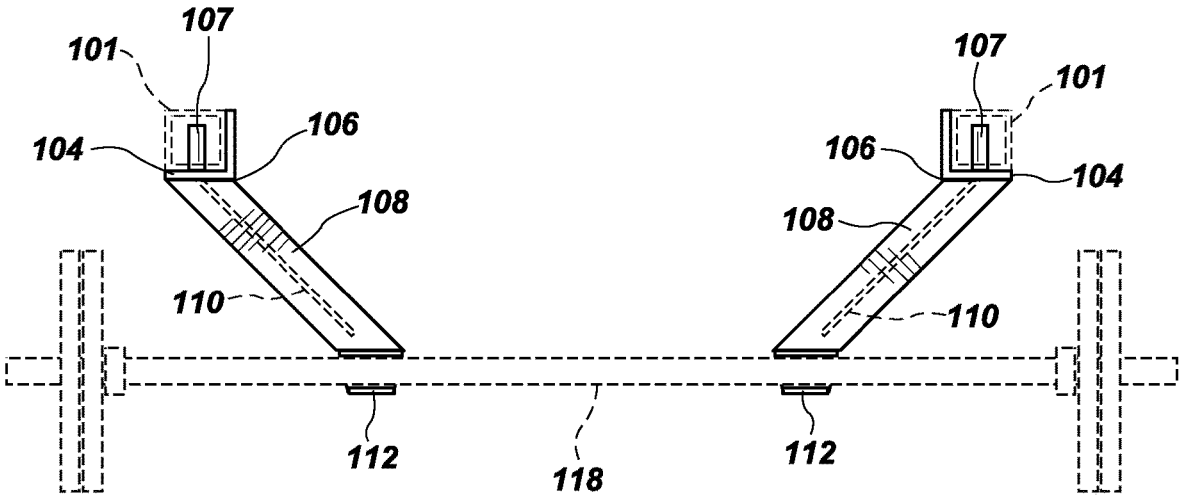
FIG. 2 is a top view of a weight rack adjustment mechanism according to one embodiment of the present invention.
Figure 3:
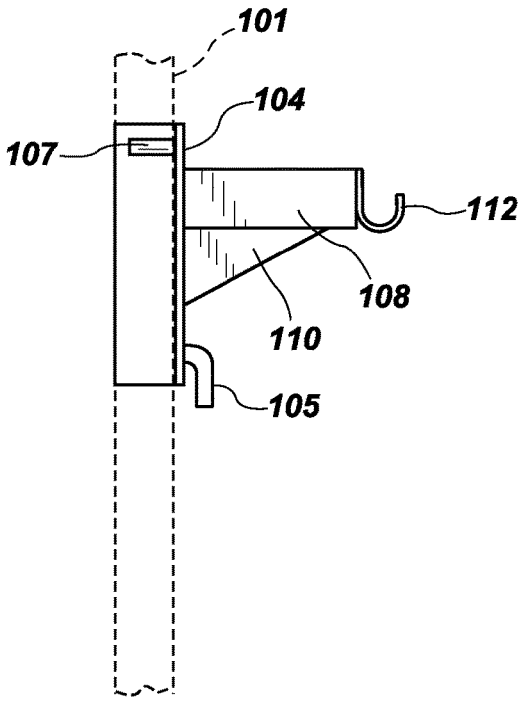
FIG. 3 is a side view of a weight rack adjustment mechanism according to one embodiment of the present invention.
Figure 5:
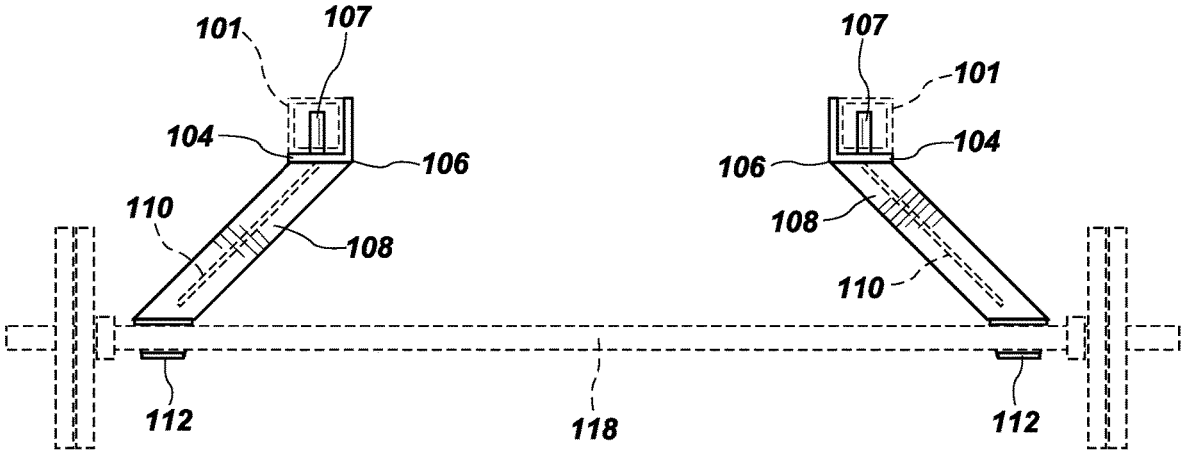
FIG. 5 is a top view of a weight rack adjustment mechanism according to one embodiment of the present invention.

FIGS. 2 and 5 illustrate the narrowing and widening capabilities of the present adjustment mechanism 100 showing a top view of the adjustment mechanism 100 on which a bar with weights 118 is resting.

Figure 6:
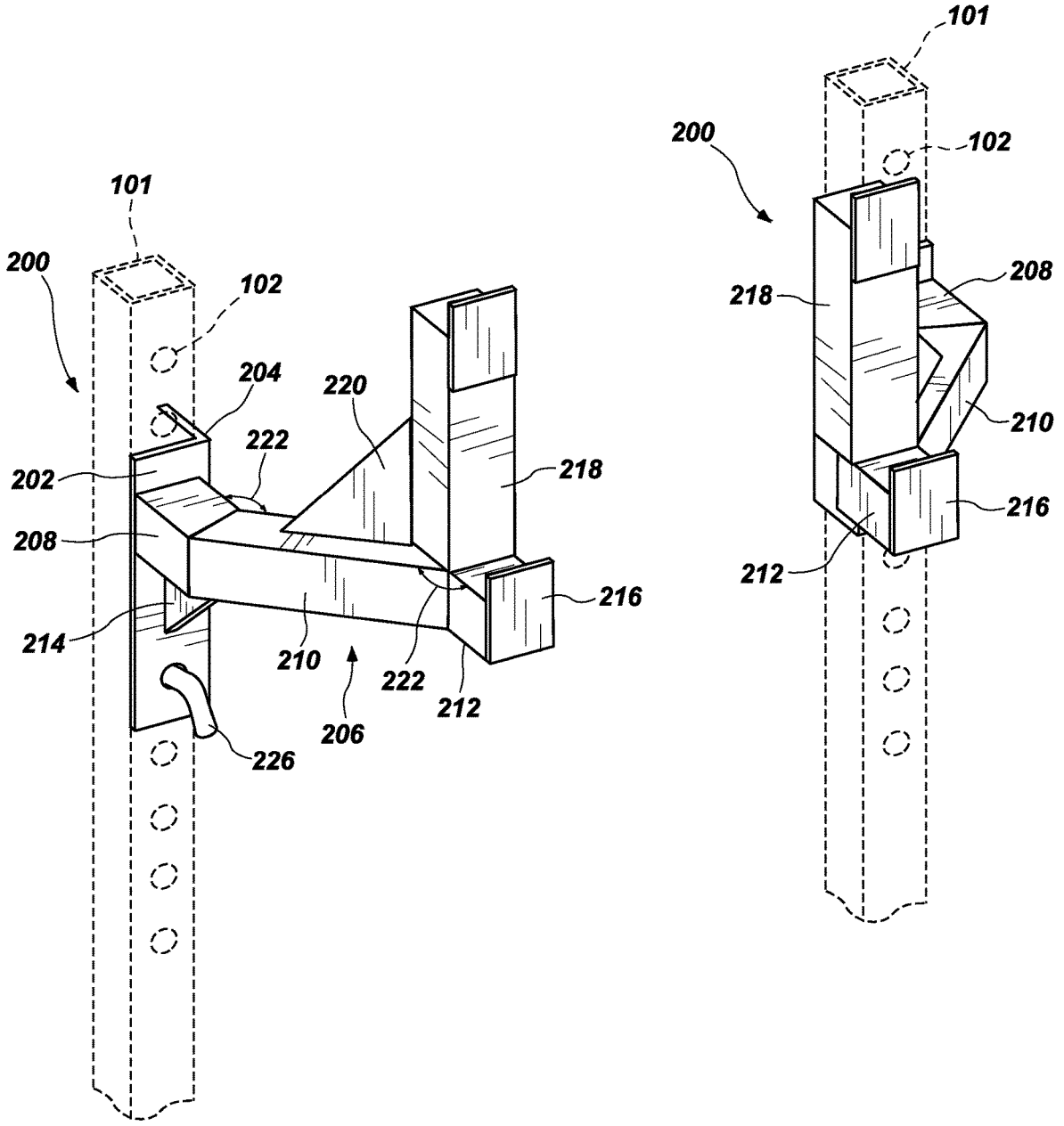
FIG. 6 is a front perspective view of a weight rack adjustment mechanism according to one embodiment of the present invention.
Figure 7:
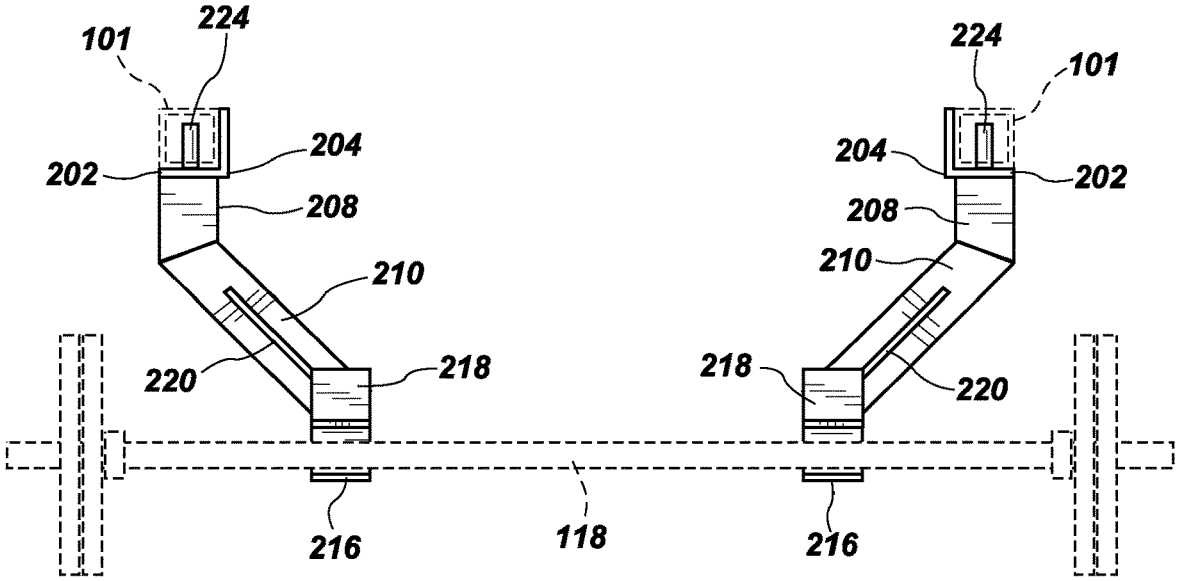
FIG. 7 is a top view of a weight rack adjustment mechanism according to one embodiment of the present invention.
Figure 8:
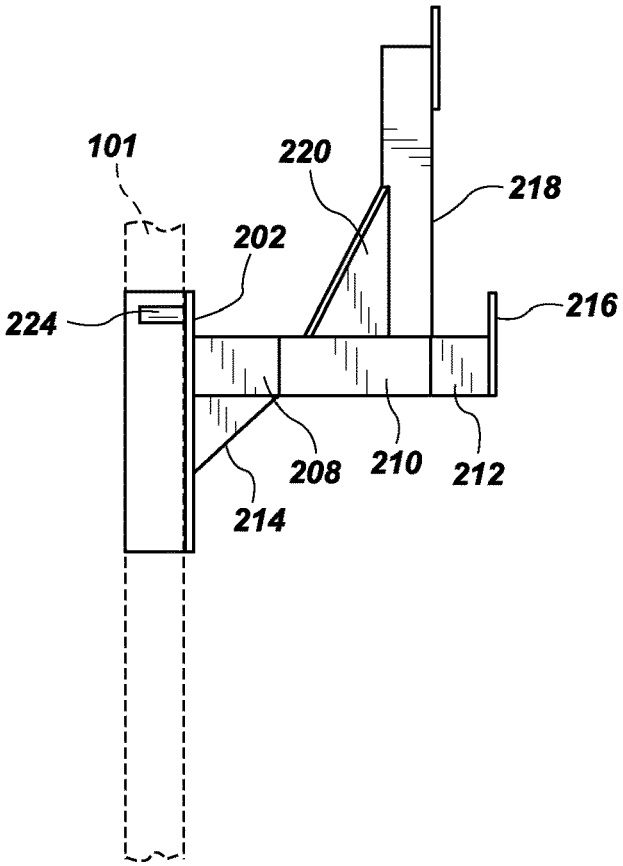
FIG. 8 is a side view of a weight rack adjustment mechanism according to one embodiment of the present invention.

FIGS. 6-8 illustrate a secondary embodiment of a weight rack adjustment mechanism 200. Adjustment mechanism 200 again comprises a base 202 with a corner support 204—again "corner" not being limited to any particular angular orientation. Horizontal piece 206 comprises three sections: a first horizontal piece 208 extending substantially straight out from base 202 with a second horizontal piece 210 angled internally (FIG. 6); and a third horizontal piece 212 that directs bar hook 216 in a substantially forward pointing orientation. It is noted that, as with the embodiment depicted in FIGS. 4 and 5, adjustment mechanism 200 could be used to either narrow or widen the rack uprights 101. In a widening embodiment, second horizontal piece 210 would be angled externally—i.e. away from the space between the rack uprights 101.

Horizontal piece 206 is supported by one or more supports 214. In the illustrated embodiment, supports 214 are triangular gusset plates affixed to the base 204 and along the underside of horizontal piece 206. In the illustrated embodiment, support rests under the first horizontal piece 208. However, in other embodiments, it may rest under the first horizontal piece 206 as well as the second 210 and in some embodiments even the third 212. Again, the gusset plate could be substantially square or rectangular or numerous other suitable polygonal shapes. The support piece 214 could connect to the base 204 and horizontal piece 206 at a single or multiple points. The support piece 214 could also be one or more rods or beams affixed to both the base 204 and the underside of the horizontal piece 206. The support piece 214 could also be of varying lengths and could attach at various points along both the base 204 and the underside of the horizontal piece 206. In some embodiments, multiple support pieces 214 could be utilized. In other embodiments, the one or more support pieces 214 can support from the top of the horizontal piece 206 rather than the bottom. In yet other embodiments, support pieces 214 can be utilized on both the top and bottom of the horizontal piece 206. In yet other embodiments, one or more support pieces 214 could affix to the sides of horizontal piece 206 as discussed in connection with other embodiments.

The adjustment mechanism 200 of this embodiment can also include a substantially vertical piece 218 that serves as a guidance system in lifting the bar off the rack upright 101 and returning it to the rack upright 101. Vertical piece 218 can be secured to the adjustment mechanism and supported in a variety of ways. The illustrated embodiment includes a gusset plate 220. However, as noted above in connection with other support pieces, the vertical piece could also be secured and supported with rods or beams. It could be secured and supported by a variety of gusset plate shapes. Such securing/supporting elements could connect to the horizontal piece 206 and vertical piece 218 at a single or multiple points. Such securing/supporting elements could vary in length. In some embodiments, multiple and varying securing/supporting elements could be used in combination.

In FIG. 6, angle 222 is approximately 135 degrees. However, in certain embodiments, it may be desirable to adjust the angle 222 to allow for a narrower adjustment mechanism 200. For example, angle 222 could be any angle lower than 180 degrees and greater than 90 degrees. Similar adjustability would also apply to embodiments widening the rack 101 allowing for a full range of adjustability.

Base 204 again can be connected to rack upright 101 with one or more connector posts 224 alone or in combination with one or more support rods 226. However, it is noted that other known methods for securing bar catches or similarly functioning posts to the rack upright 101 could also be utilized in connection with securing the base 204 to the rack upright 101.

Figure 9:
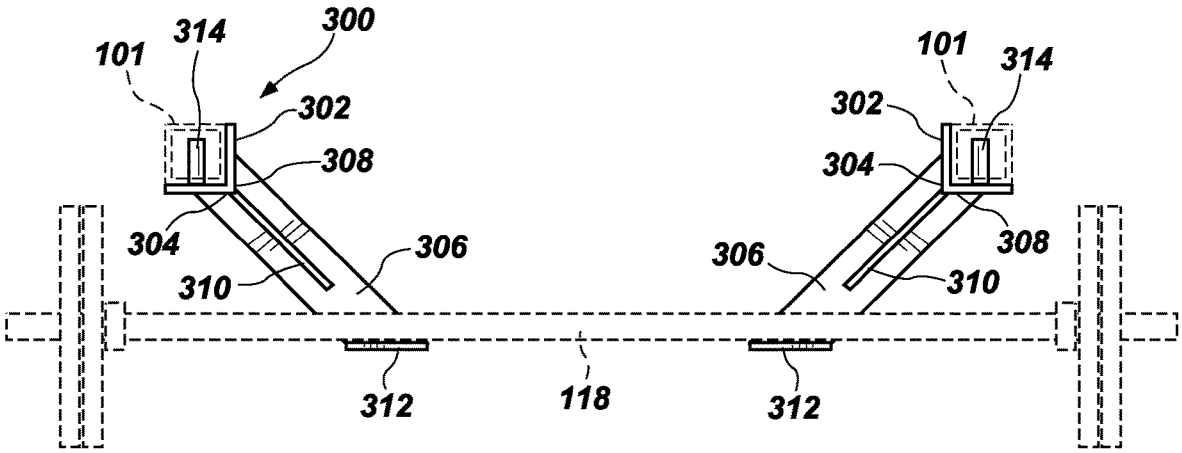
FIG. 9 is a top view of a weight rack adjustment mechanism according to one embodiment of the present invention.
Figure 10:
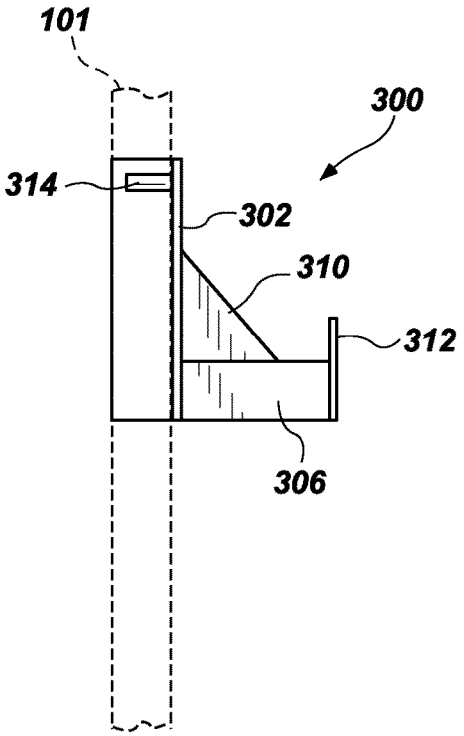
FIG. 10 is a side view of a weight rack adjustment mechanism according to one embodiment of the present invention.
Figure 11:
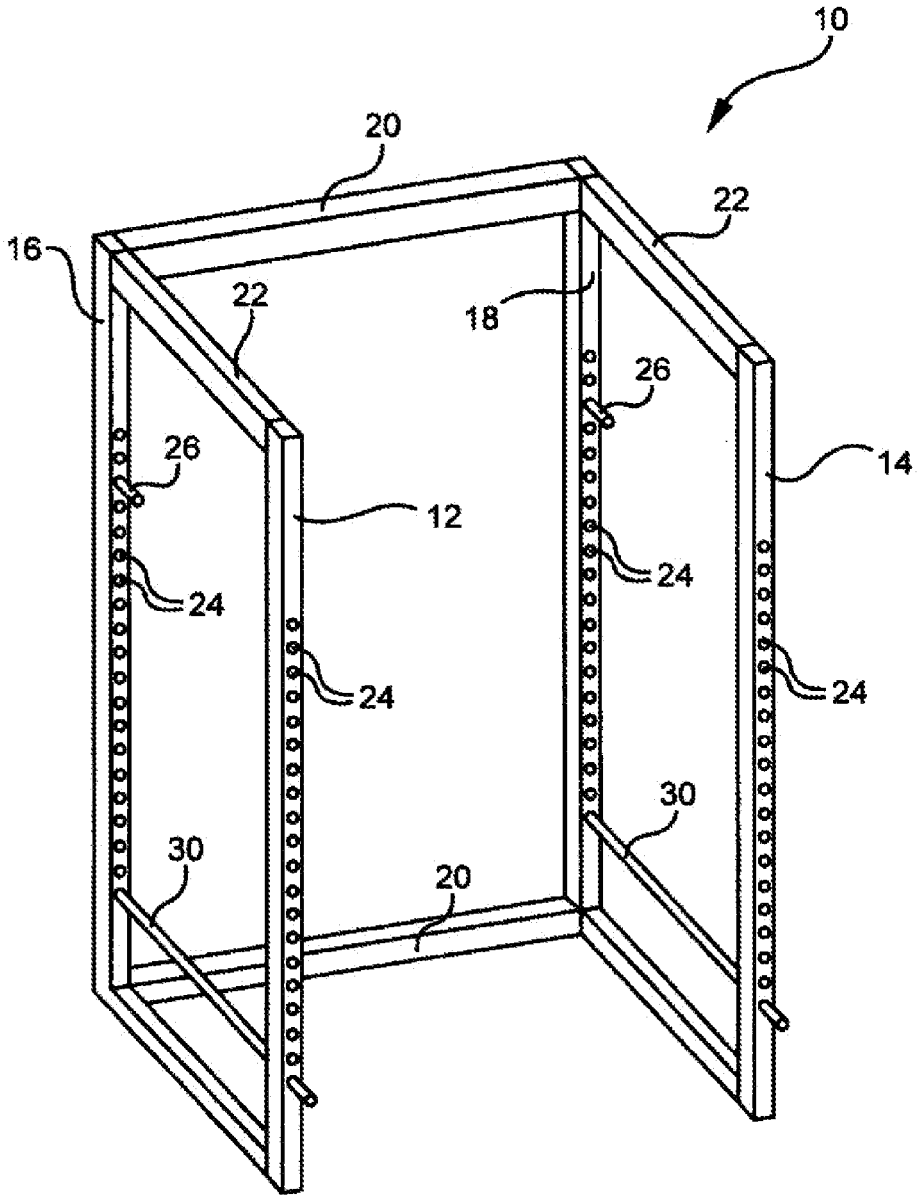
FIG. 11 is a depiction of a known power lifting rack.

FIGS. 9 and 10 illustrate yet another embodiment of a rack adjustment mechanism 300 according to the present invention. This adjustment mechanism 300 includes a base 302 with a corner 304 that corresponds to a notch 308 in horizontal piece 306. This adjustment mechanism 300 could, similar to other embodiments discussed herein, can be configured to narrow or widen the rack uprights 101, though FIG. 9 only depicts the narrowing embodiment. Notch 308 could be configured to allow the horizontal piece 306 to assume a variety of angles. For example, the notch 308 could be cut approximately evenly on both sides—as is shown in FIG. 9—creating approximately a 45 degree angular orientation relative to the bar 118. By cutting the notch 308 longer or shorter on either side, the angular orientation of the horizontal piece 306 can be increased or decreased relative to the bar 118. Put another way, by adjusting the notch cuts, the horizontal piece 306 can have just short of a 180 degree range to accommodate substantially all narrowing and widening configurations.

In all embodiments, the length of the horizontal piece 108, 206, 306 can vary according to need provided they allow for the purposes of the rack adjustment mechanism 100, 200, 300 to be accomplished. The horizontal piece 108, 206, 306 can also be a variety of cross-sectional shapes alone or in combination including, but not limited to circular or substantially circular, or polygonal. Horizontal piece 108, 206, 306 could also be a substantially flat piece. Horizontal piece 108, 206, 306 as well as all other elements of the invention described in the present application could also be made of a variety of materials as would be apparent to one skilled in the art provided they had the necessary weight-bearing capacity.

Referring again to FIGS. 9 and 10, horizontal piece 306 terminates with bar hook 312 and can be secured to base 302 by a support piece 310. The nature, number and configurations of this support piece 310 can vary as discussed elsewhere herein. The illustrated embodiment shows a gusset plate securing a top surface of the horizontal piece 306 to base 302.

Base 304 again can be connected to rack upright 101 with one or more connector posts 314 alone or in combination with one or more support rods (not shown). However, it is noted that other known methods for securing bar catches or similarly functioning posts to the rack upright 101 could also be utilized in connection with securing the base 304 to the rack upright 101.

What is claimed is:

1. A bar catch for adjusting a distance between a first weight rack upright and a second weight rack upright, wherein the first weight rack upright includes a first front face that is oriented in a first direction and the second weight rack upright includes a second front face that is oriented in the first direction, the bar catch comprising:

a first base that conforms to the first front face of the first weight rack upright;

a first horizontal piece coupled at a first proximal end to the first base wherein the first horizontal piece is oriented toward the second weight rack upright at a first angle relative to the first front face of the first weight rack upright and wherein the first angle is less than 90 degrees and greater than zero degrees;

a first bar hook coupled to a first distal end of the first horizontal piece wherein the first bar hook is oriented at a second angle relative to the first horizontal piece such that the first bar hook is oriented in the first direction; and wherein the second angle is less than 90 degrees and greater than zero degrees;

a second base that conforms to the second front face of the second weight rack upright;

a second horizontal piece coupled at a second proximal end to the second base wherein the second horizontal piece is oriented toward the first weight rack upright at a third angle relative to the second front face of the second weight rack upright and wherein the third angle is less than 90 degrees and greater than zero degrees; and a second bar hook coupled to a second distal end of the second horizontal piece wherein the second bar hook is oriented at a fourth angle relative to the second horizontal piece such that the second bar hook is oriented in the first direction; and wherein the fourth angle is less than 90 degrees and greater than zero degrees.

2. The bar catch of claim 1, wherein the first angle is approximately 45 degrees.

3. The bar catch of claim 1, wherein the second angle is approximately 45 degrees.

4. The bar catch of claim 1, wherein each of the first base and the second base include a corner support.

5. The bar catch of claim 1, further comprising a first support piece coupled to the first horizontal piece and a second support piece coupled to the second horizontal piece, and wherein the first and second support pieces are a first gusset plate and a second gusset plate respectively.

6. The bar catch of claim 5, wherein the first and second gusset plates are positioned beneath the first and second horizontal pieces respectively.

7. The bar catch of claim 5, wherein the first and second gusset plates are positioned above the first and second horizontal pieces respectively.

8. The bar catch of claim 1, wherein each of the first base and the second base include one or more detachable base connector rods.

9. The bar catch of claim 1, wherein each of the first base and the second base include one or more backside posts.

* * * * *